US005795708A

United States Patent [19]

Boutet

[11] Patent Number: 5,795,708

[45] Date of Patent: Aug. 18, 1998

[54] USE OF A DICHROIC MIRROR ANTIHALATION LAYER FOR SPEED AND SHARPNESS BOOST

[75] Inventor: John Claude Boutet, Rochester, N.Y.

[73] Assignee: Eastman Kodak Company, Rochester, N.Y.

[21] Appl. No.: 698,711

[22] Filed: Aug. 16, 1996

[51] Int. Cl.[6] ..... G03C 1/498

[52] U.S. Cl. ..... 430/617; 430/510; 430/517; 430/619

[58] Field of Search ..... 430/617, 619, 430/7, 510, 507, 511, 517

[56] References Cited

U.S. PATENT DOCUMENTS 5,217,832 6/1993 Joslin et al. ..... 430/7

*Primary Examiner*—Thorl Chea

*Attorney, Agent, or Firm*—William F. Noval

[57] ABSTRACT

A heat processable film comprising:

a base layer;

a dichroic mirror layer; and a heat processable emulsion layer which is exposed by radiation having a predetermined range of wavelengths; wherein the dichroic mirror layer reflects radiation at least having the predetermined range of wavelengths to the emulsion layer and transmits radiation having wavelengths outside the predetermined range of wavelengths.

7 Claims, 2 Drawing Sheets

USE OF A DICHROIC MIRROR ANTIHALATION LAYER FOR SPEED AND SHARPNESS BOOST

BACKGROUND OF THE INVENTION

In most photographic emulsions, part of the light which enters the emulsion passes through the emulsion without being absorbed. For emulsions coated on transparent emulsion supports such as plastic film base, light which passes through the emulsion can travel through the base and reflect of the rear surface of base (or a surface behind the base) to reexpose the emulsion in an area near where it passed through.

Multiple reflection in the base (light piping) can spread the light far from where it was originally focused. When imaging a point light source on such a film system the image of the point is surrounded by a fuzzy dot or halo caused by the reflected light. To eliminate this problem, an "antihalation" layer is added to the film structure to absorb the light which passes through the emulsion. This absorptive antihalation layer can be placed between the emulsion and base or on the back side of the base to absorb the light which passed through the emulsion. The net effect is a significant improvement in resolution at the cost of a reduction in film speed. The antihalation layer must be eliminated after the film has been exposed to permit viewing the film properly after processing.

In "dry silver" film systems, a heat processable silver behenate emulsion is used. These emulsions are characteristically quite clear because they scatter and absorb little of the light passing through them. This makes them slow and very susceptible to halation artifacts if an antihalation layer is not used. The antihalation layer must be cleared by a reaction initiated by the heat processing or by subsequent exposure to light.

SUMMARY OF THE INVENTION

For dry silver films (or other clear emulsion films) which are exposed by a narrow wavelength band light source, a dichroic mirror coating could be used as an antihalation coating. This dichroic coating would be designed to reflect the exposing wavelength while passing the rest of the visible spectrum. By placing such a coating between the emulsion and the film base, the light passing through the emulsion would be reflected back through the emulsion to nearly double the film exposure. Since this dichroic mirror antihalation layer is transparent to most of visible spectrum, it would not need to be "bleached" for viewing.

If the dichroic mirror is made reflective to the infrared (IR) wavelengths, the dichroic coating can also serve to keep the media cooler when viewing over a hot light source.

A speed boost could also be achieved by using a thin translucent highly diffusing layer under the emulsion to scatter a large percentage of the light back through the emulsion. When viewed over a lightbox, the diffusing layer in the film would combine with the diffuser in the lightbox and would add little visible density to the film. When viewed over a specular light source, it would provide a built in diffuser to the film, making the image on the film easier to view.

ADVANTAGEOUS EFFECT OF THE INVENTION

The primary advantage of using the dichroic mirror antihalation coating described in FIG. 1 is the approximately 2× speed gain achieved. For applications here hotlight protection is needed, the reflection wavelength range of the coating can be extended over the necessary portions of the IR range to avoid heat absorption in the emulsion. The film construction shown in FIGS. 3 and 4 would provide a speed boost of 1.3× to 1.5× and be less expensive to manufacture than the dichroic mirror construction. The opalescent appearance of this film, however, would probably limit it to niche market applications.

DETAILED DESCRIPTION OF THE INVENTION

Figure 1:
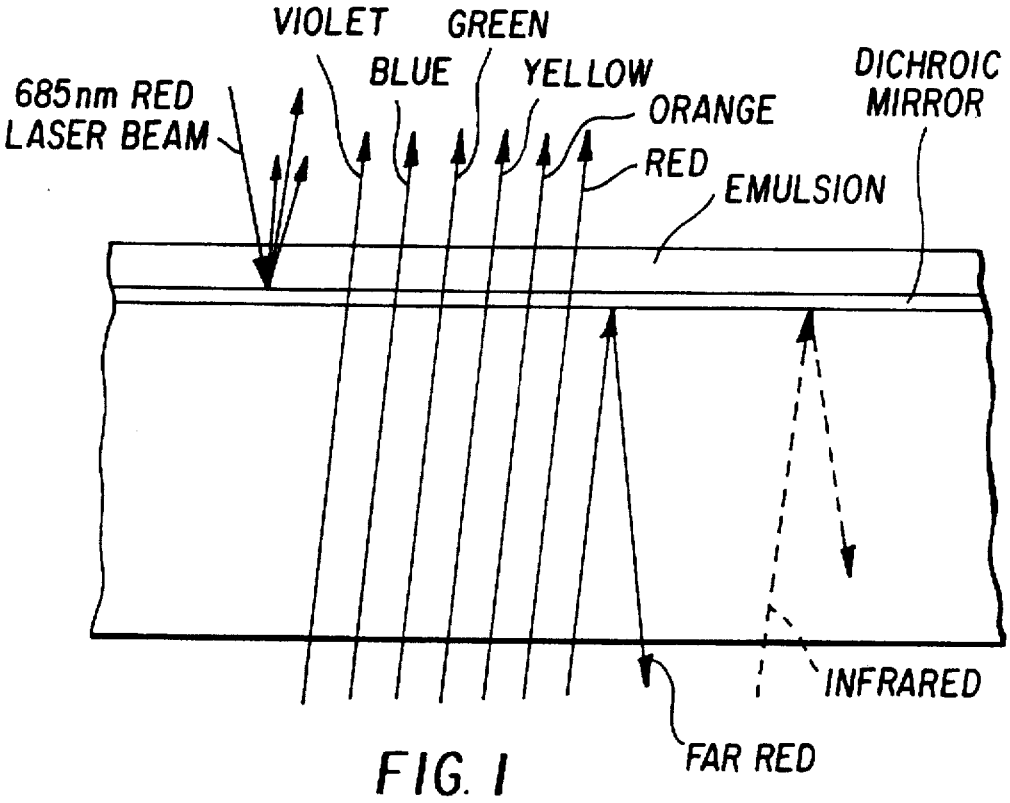
FIG. 1 is a diagrammatic view illustrating an embodiment of the present invention.

FIG. 1 illustrates how a possible dichroic antihalation layer would function. In this case, the dichroic layer is designed for a film which is exposed with far red wavelength from a source such as a 685 nm laser. This dichroic layer is designed to be a "hot mirror" which reflects wavelengths longer than 670 nm. The figure also illustrates how the dichroic layer would function after processing for viewing the image with the visible spectrum. FIG. 1 also depicts how the IR reflecting nature of this coating would reduce emulsion heating by reflecting the IR back out the back of the film to prevent IR absorption in the emulsion.

In FIG. 1, clipping the far red portion of the spectrum above 670 nm with the dichroic mirror coating has little effect on the apparent color of the light passing through the film because the eye is not very sensitive to the far red wavelengths. This is particularly the case when viewing films on a lightbox illuminated with fluorescent lights which do not have emission peaks in that wavelength range. When such a "cut-off" filter/mirror coating is viewed at an angle, however, the frequency it cuts off shifts toward the shorter wavelengths as the angle from the filter surface normal increases. At 45° from normal, the cut-off frequency in this wavelength range shifts about 50 nm towards the blue and a lightbox viewed through the dichroic coating at 45° will have a bluish cast. For this reason, it is best to design such a laser printer/film system to expose the film near or in the IR wavelength range so that the dichroic antihalation layer designed for the system does not cause a visible blue shift when viewed at an angle.

If the printer/film system could be designed to expose in the violet or UV range, the cut-off frequency shift would not be a problem. For the "cold mirror" dichroic antihalation coating which would be needed for such a system the shift would be toward the UV and less visible light would be cut off. Therefore, if the dichroic filter showed no noticeable color tinge at a viewing angle normal to the film, the cut-off shift under angled viewing conditions will not cause a visible color shift problem either.

Figure 2:
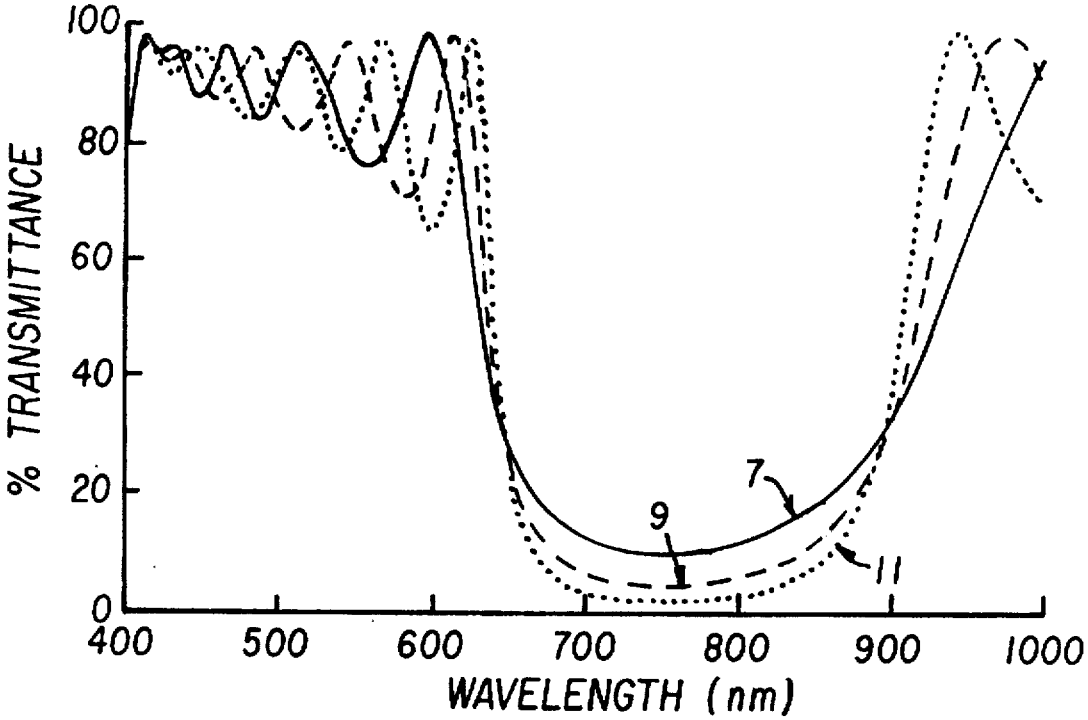
FIG. 2 is a graphical view of transmittance vs. wavelength for a dichroic mirror layer.

Given the current state-of-the-art in laser diodes, working on the red end of the spectrum, as is illustrated in FIG. 1, is currently the most practical. The ideal "hot mirror" dichroic coating for such a system would have a sharp cut-off at 10 to 15 nm on the short wavelength side of the laser frequency used to expose the film. This margin would allow for the manufacturing variability in the laser and dichroic coating. Ideally high reflectivity would extend throughout the IR range for hot light protection. To minimize cost, however, the design will need to concentrate primarily on passing as much of the visible wavelengths as possible while reflecting the laser wavelength well. FIG. 2 shows the percent transmittance of a 7, a 9, and an 11 layer dichroic mirror over a wavelength range from 400 to 1000 nm. As can be seen, the seven layer mirror coating cut-off brings transmittance down to 15% for a 685 nm wavelength laser beam. This is adequate for antihalation protection. The coatings in FIG. 2 all become quite transmissive again for IR wavelengths longer than 900 nm and would therefore provide limited "hot mirror" protection for films viewed over a hog light. To extend low transmittance throughout the IR range would require 2 to 3 times the number of layers in the dichroic mirror coating. This would raise the cost of the coating and make the desired good transmittance in the 400 nm to 650 nm range more difficult to maximize. Note that part of the cycling in the transmittance curves in the 400 nm to 650 nm range in FIG. 2 can be reduced by fine adjustments to the relative thicknesses of the layers in each of the three coatings shown. This would improve transmission of visible light.

Figure 3:
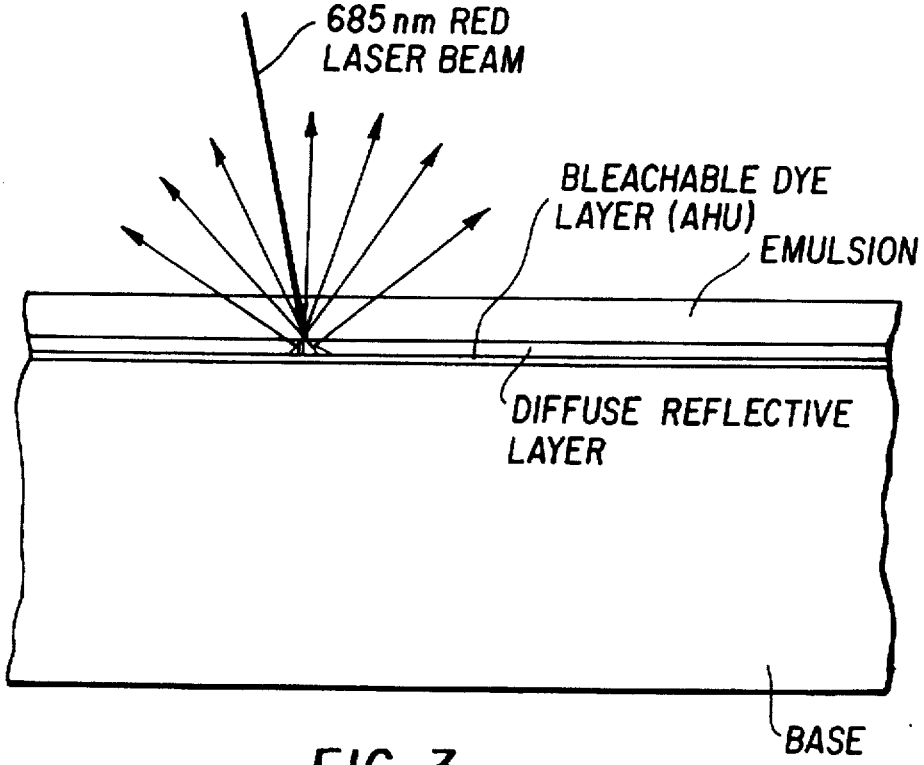
FIG. 3 is a diagrammatic view illustrating another embodiment of the present invention.
Figure 4:
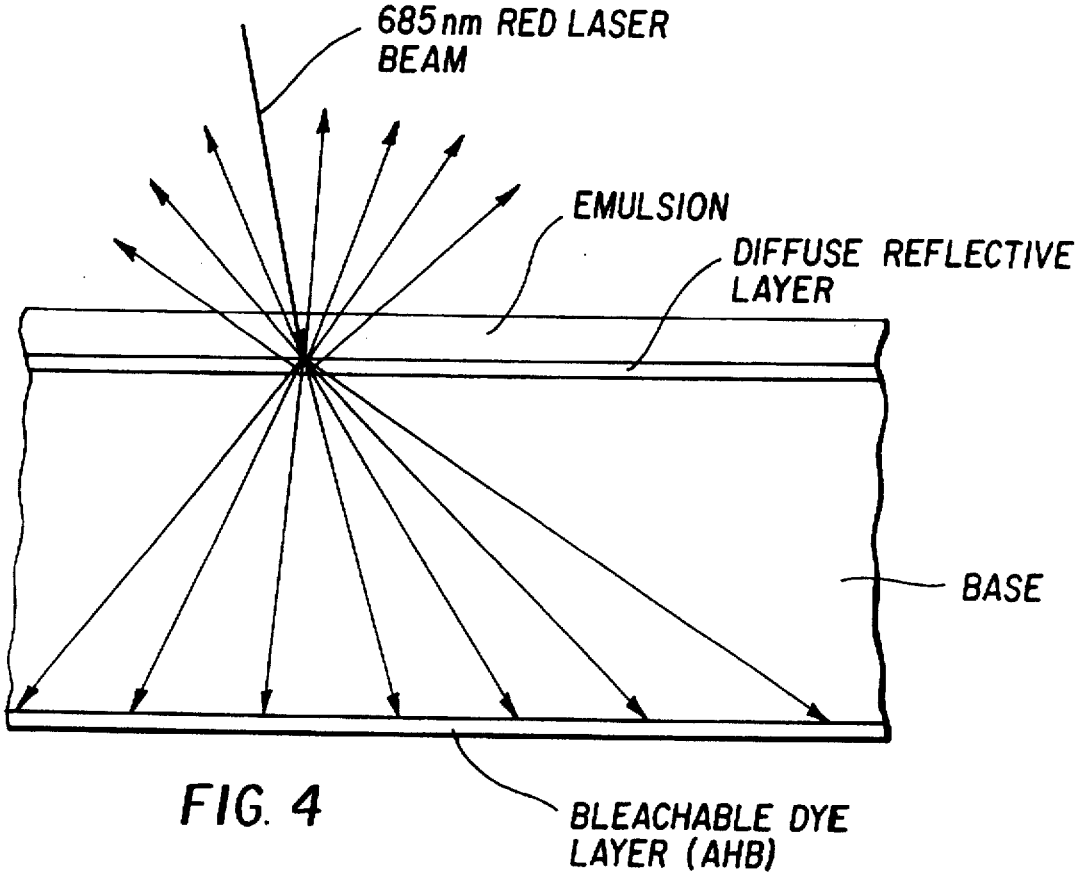
FIG. 4 is a diagrammatic view illustrating a further embodiment of the present invention.

An alternative way of getting a speed boost with an antihalation coating (or at least avoid a speed loss) is to use a diffuse reflective layer under the emulsion in front of the absorbing dye layer. Two embodiments of this concept are shown in FIGS. 3 and 4. In FIG. 3, the diffuse reflective layer is sandwiched between the emulsion and an antihalation undercoat (AHU). The reflective layer must be thin, have low light absorption and high light scattering proper-ties. This might be achieved by the use of titanium dioxide particles or microbubble suspension in a clear matrix. The percentage of light which is reflected back through the emulsion must be chosen to provide the most exposure boost while meeting the necessary Dmin specifications for the film. Light which passes through this diffusing layer is absorbed in the AHU layer which can use a light or heat bleached dye for absorption.

Rather than placing the antihalation dye layer between the diffusing layer and the base (AHU) as shown in FIG. 3, the antihalation dye layer can be placed on the back side of the base (AHB) as shown in FIG. 4. As long as there is good index matching between the AHB coat and the base this construction is as effective at preventing halation and has the advantage of avoiding potential chemical reaction or diffusion of AHU dye into the light diffusing layer or emulsion layer during the coating process.

It should be noted that photographic paper is the extreme case of this exposure boosting approach. For that case transmittance through the paper can be zero and as much light as possible is reflected by the emulsion sub layer to minimize the reflection Dm since the image is viewed by reflected light. Since most of the light is reflected, the dye layer is not needed.

A preferred dichroic layer is formed from multilayers of alternating layers of silicon dioxide and titanium dioxide. A suitable heat processable emulsion layer is formed of silver behenate emulsions.

The invention has been described in detail with particular reference to preferred embodiments thereof, but it will be understood that variations and modifications can be effected within the spirit and scope of the invention as described above and as defined in the appended claims.

What is claimed is:

1. A photosensitive film comprising:

a base layer;

a continuous dichroic mirror layer over said base layer; and a photosensitive dry silver layer over said dichroic mirror layer;

wherein said dry silver layer is exposed by a radiation of narrow range of wavelengths and wherein said dichroic mirror reflects exposure radiation of said narrow range of wavelengths but transmits radiation having wavelengths outside said narrow range of wavelengths;

wherein the exposure speed of said film is substantially increased when exposed to radiation of said narrow range of wavelengths by reflecting said exposure radiation back to said dry silver layer.

2. The film of claim 1 wherein said dry silver layer is a silver behenate layer.

3. The film of claim 1 wherein said narrow range of wavelengths of said exposure radiation is in the infrared to far red range of wavelengths and wherein said dichroic mirror reflects radiation in said infrared to far red range of wavelengths but transmits radiation in the visible range of wavelengths.

4. A photosensitive film comprising:

a base layer;

a bleachable dye antihalation layer on said base layer;

a diffuse reflective layer on said antihalation layer, said diffuse reflective layer having low radiation absorption and high light scattering properties; and a photosensitive dry silver layer over said diffuse reflective layer.

5. The film of claim 4 wherein said diffuse reflective layer is of titanium dioxide.

6. The film of claim 4 wherein said diffuse reflective layer is a microbubble suspension in a clear matrix.

7. A photosensitive film comprising:

a bleachable dye antihalation layer;

a base layer;

a diffuse reflective layer; and a dry silver photosensitive layer.

* * * * *